US007024820B1

(12) United States Patent
Dustin

(10) Patent No.: US 7,024,820 B1
(45) Date of Patent: Apr. 11, 2006

(54) SLIDING DOOR SECURITY ASSEMBLY

(76) Inventor: Myron R. Dustin, 1792 Oak Lanes Dr., Sarasota, FL (US) 34232

( * ) Notice: Subject to any disclaimer, the term of this patent is extended or adjusted under 35 U.S.C. 154(b) by 189 days.

(21) Appl. No.: 10/766,160

(22) Filed: Jan. 28, 2004

(51) Int. Cl.
*E05D 15/48* (2006.01)
*E06B 7/28* (2006.01)
*E06B 7/00* (2006.01)
*E06B 3/12* (2006.01)

(52) U.S. Cl. ..... 49/168; 49/57; 49/55; 49/464; 49/501; 160/217; 160/105

(58) Field of Classification Search ..... 49/168, 49/169, 170, 171, 55, 50, 57, 463, 465, 464, 49/70, 501; 160/215, 217, 105; 52/202, 52/204.1, 656.7, 455, 458
See application file for complete search history.

(56) References Cited

U.S. PATENT DOCUMENTS 3,464,158 A * 9/1969 Greene ..... 49/168
3,654,733 A * 4/1972 Blackwell ..... 49/168
4,020,595 A * 5/1977 Duncan ..... 49/306
4,226,049 A 10/1980 Maust
4,400,912 A 8/1983 Wicks, Sr.
4,408,416 A * 10/1983 Davlantes ..... 49/168
4,478,002 A 10/1984 English
4,484,410 A 11/1984 English
5,048,587 A * 9/1991 York ..... 160/217
5,105,868 A 4/1992 Riise
5,185,954 A * 2/1993 Waddle, Sr. ..... 49/168
5,392,570 A 2/1995 Cowan
5,446,996 A 9/1995 Lamont
5,575,321 A 11/1996 Currier
5,946,855 A * 9/1999 Miconi ..... 49/168
6,182,397 B1 2/2001 Almond
6,276,091 B1 * 8/2001 Ridgway ..... 49/125
6,532,703 B1 * 3/2003 Barrens ..... 52/202
6,691,483 B1 * 2/2004 Lethers ..... 52/455

* cited by examiner

*Primary Examiner*—Hugh B. Thompson, II
(74) *Attorney, Agent, or Firm*—Charles J. Prescott

(57) ABSTRACT

A sliding door security insert assembly installable into an opening made when one sliding door mounted for lateral movement within a door frame is partially opened to define the opening between one door jamb and a facing sliding door stile. A substantially rectangular insert frame includes a lower transverse member adapted to be supported on the lower track while said upper transverse member is adapted to be positioned into the upper track for lateral sliding movement only. An elongated locking shim is positionable between the upper transverse member and the upper track prevents insert frame removal. Offset locking pins attached to one insert frame stile are adapted to be inserted into a mating hole formed into the facing sliding door stile and visa versa whereby the insert frame and the sliding door are connectable together. Full adjustability in height and mating thickness with the existing sliding door edge is also provided.

4 Claims, 7 Drawing Sheets

SLIDING DOOR SECURITY ASSEMBLY

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to secure ventilating systems for building sliding doors and more particularly to a security insert door assembly for use in sliding doors to maintain adequate security when the sliding door is partially opened for ventilation.

2. Description of Related Art

In sliding door installations for both home and office, a separate screen slidably positioned outwardly from the sliding doors themselves is typically provided for ventilation while maintaining an adequate insect barrier. However, such screen door additions are of little use in maintaining the security of interior of the home or building as such screens are quite easy to either cut through or totally be removed, providing immediate access into the interior of the home or building.

One arrangement for resolving this security issue is disclosed in U.S. Pat. No. 5,105,868 invented by Riise which teaches a sliding door security screen positionable within the opening established by a sliding door when it is partially opened.

A security ventilating system invented by Maust in U.S. Pat. No. 4,226,049 also teaches an open lattice structure installable into the opening of a partially opened sliding door wherein the open lattice structure provides adequate ventilation while preventing a person from gaining access into the interior of the building either through the openings of the lattice or by its total removal.

The following additional U.S. patents also teach other unique forms of security door and window panels which are somewhat more remote with respect to the inventive concept of the present invention.

U.S. Pat. No. 4,484,410 to English
U.S. Pat. No. 5,575,321 to Currier
U.S. Pat. No. 5,446,996 to Lamont
U.S. Pat. No. 5,392,570 to Cowan
U.S. Pat. No. 4,400,912 to Wicks, Sr.
U.S. Pat. No. 6,182,397 to Almond
U.S. Pat. No. 4,478,002 to English The present invention provides a security insert door assembly which is installable into the opening of a sliding glass door in its partially opened position. A locking pin and aligned mating locking pin hole arrangement helps insure that the strength and integrity junction between the facing door stile of the sliding door and that of the insert frame is maintained. Adjustable-in-width sliding door stile engaging flanges are alternately provided which accommodate differences in overall thicknesses between the insert frame stile and the sliding door stile. Universal features includes an insert frame having a standard height no greater than the shortest sliding door height expected to be encountered in the marketplace. Where taller sliding doors are encountered, a separate upper panel is attachable to the upper transverse member of the insert frame which may be selectable from a variety of panel heights for attachment to the insert frame to exactly match the height of the sliding door.

BRIEF SUMMARY OF THE INVENTION

This invention is directed to a sliding door security insert assembly installable into an opening made when one sliding door mounted for lateral movement within a door frame is partially opened to define the opening between one door jamb and a facing sliding door stile. A substantially rectangular insert frame includes a lower transverse member adapted to be supported on the lower track of the sliding door frame while said upper transverse member is adapted to be positioned into the upper track for lateral sliding movement only there along. An easily adjusted-in-height embodiment is preferred. An elongated locking shim is positionable between the upper transverse member and the upper track to prevent insert frame removal. A pair of locking pins are alternately attached, one to the edge of the insert frame stile and the other to the edge of the facing sliding door stile, each locking pin being adapted to be inserted into a mating hole formed into the facing stile surface whereby the insert frame and the sliding door are securely connectable when closed together.

It is therefore an object of this invention to provide a sliding door security inset assembly which fills an opening made when a sliding door is partially opened a predetermined amount to provide ventilation into the home.

It is yet another object of this invention to provide a uniquely configured sliding door security inset assembly which itself is rendered non-removable from the outside once installed into the sliding door frame against a partially opened sliding door for ventilation.

Yet another object of this invention is to provide interengaging structure between the inset frame stile and the facing stile of the sliding door.

A still further object of this invention is to provide a universal sliding door inset assembly which is adjustable in height and in interengaging features with respect to the sliding door of virtually any sliding door arrangement while providing both ventilation and security.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
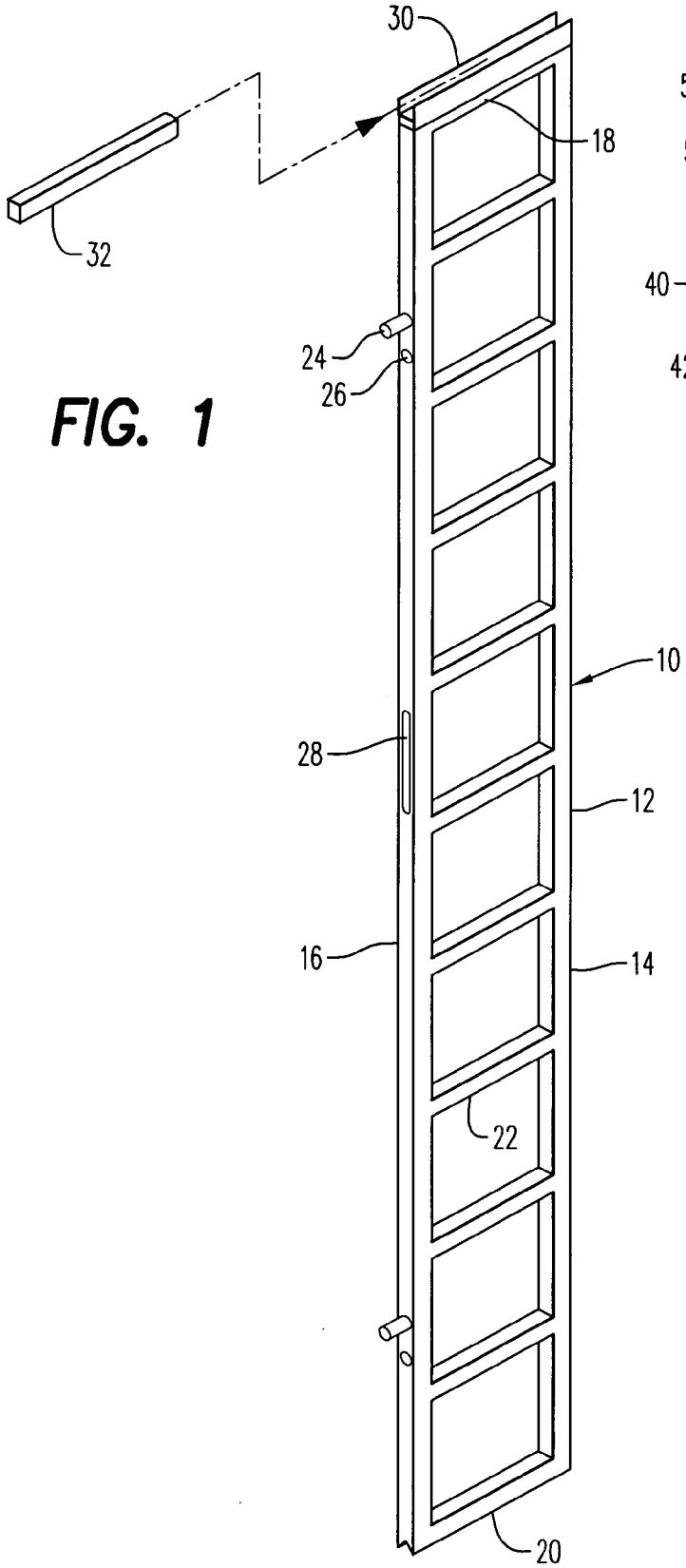
FIG. 1 is an exploded perspective view of one embodiment of the invention.
Figure 2:
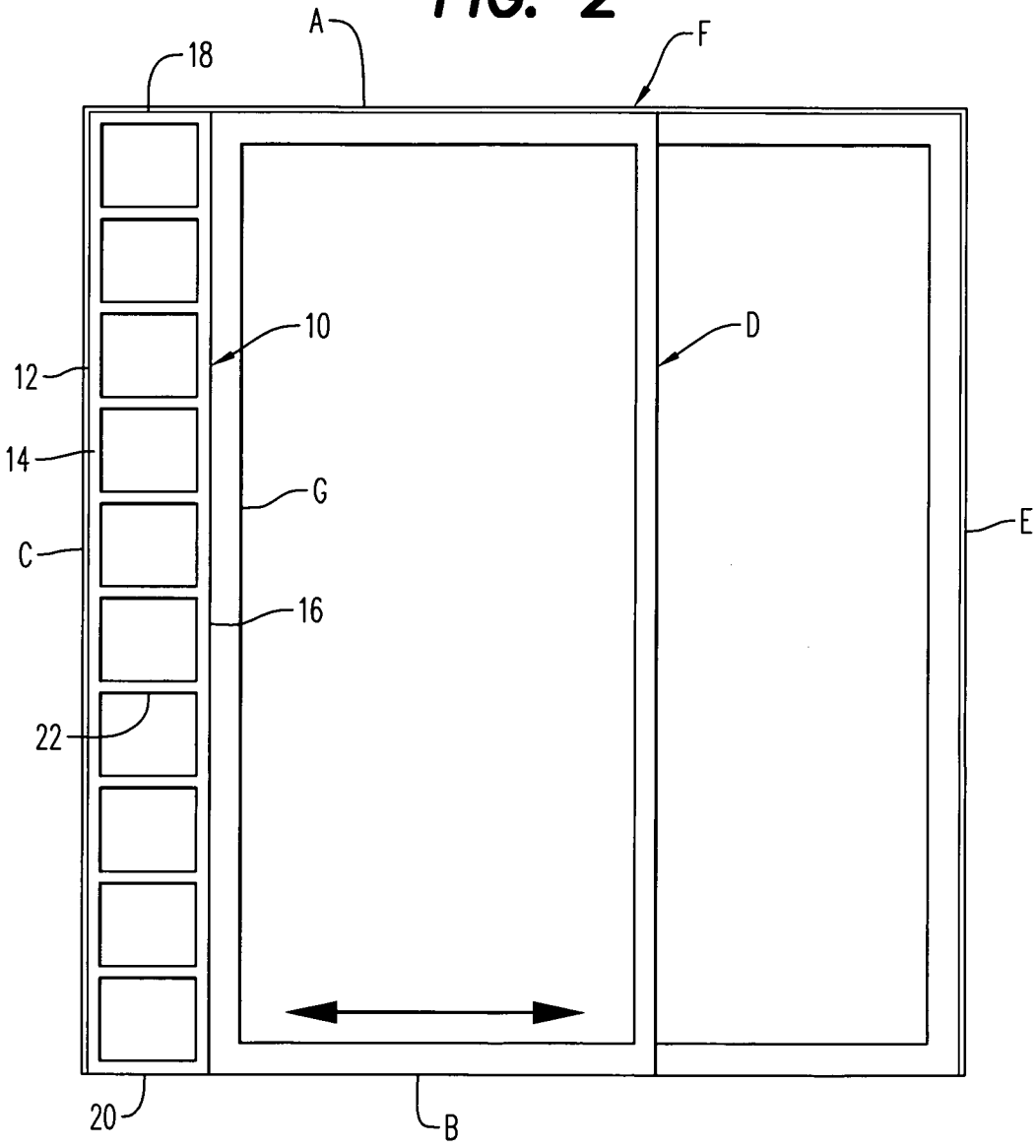
FIG. 2 is a front elevation view of the invention shown in FIG. 1 installed into a sliding door frame arrangement.

Referring now to the drawings, one embodiment of the invention is shown generally at numeral 10 in FIGS. 1 and 2. This sliding door security insert assembly 10 includes a substantially rectangular insert frame 12 which is formed of two elongated spaced apart upright tubular insert frame stiles 14 and 16 which are rigidly connected to spaced upper, lower and intermediate tubular transverse members 18, 20 and 22, respectively. This insert frame 12 may be fabricated of welded tubular aluminum components or manufactured by other conventional assembly techniques.

Figure 3:
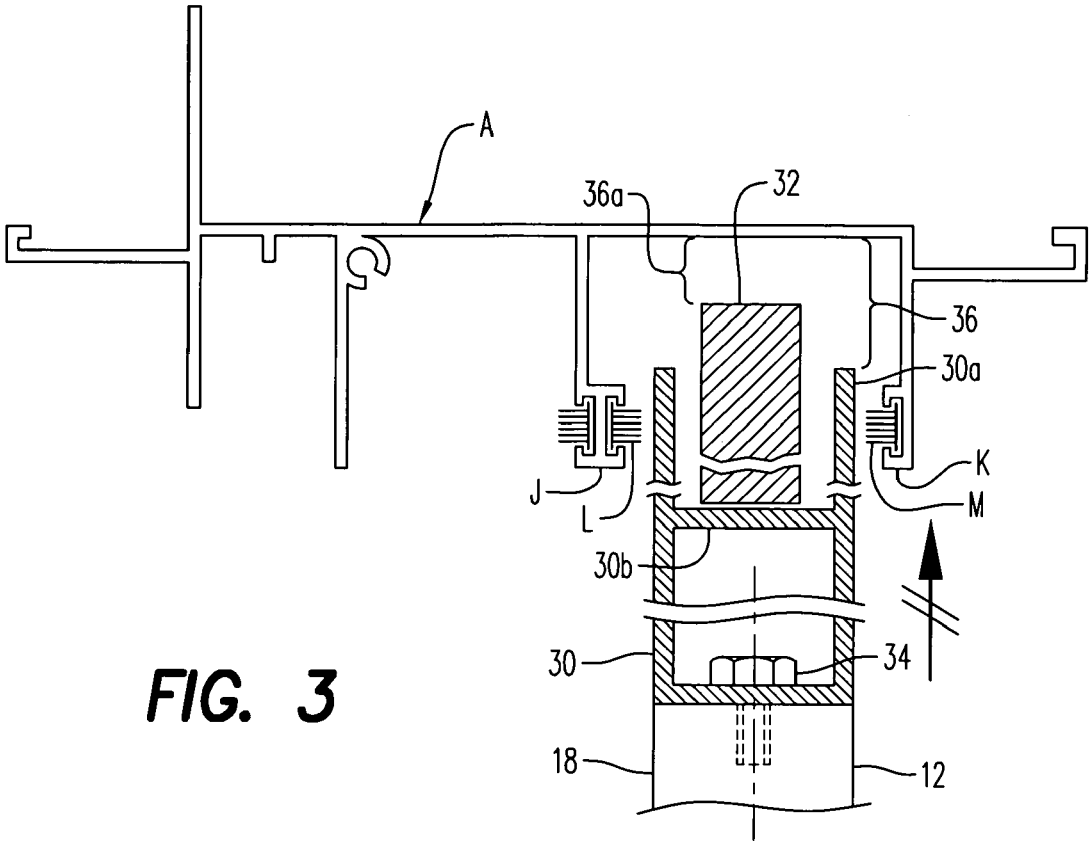
FIG. 3 is a side elevation partial section view of the upper portion of the invention as shown in FIG. 2 in conjunction with the upper sliding door frame track into which it engages.
Figure 4:
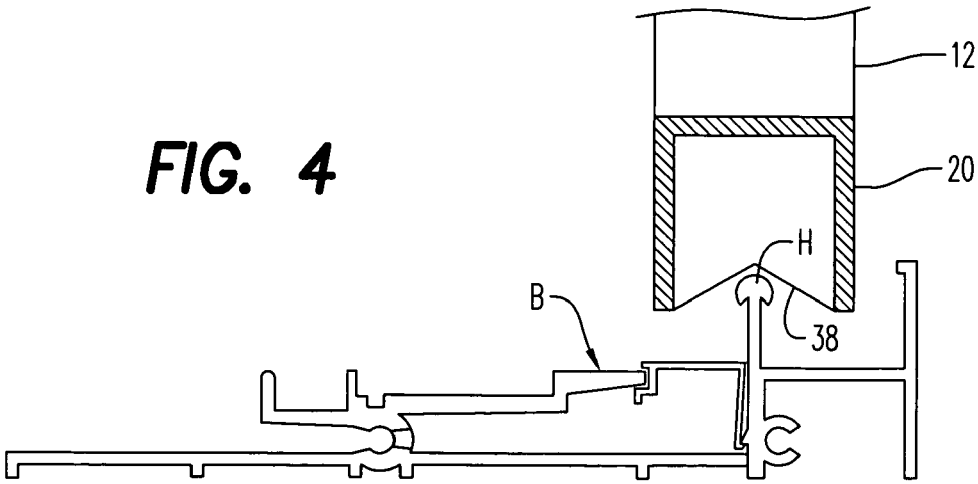
FIG. 4 is a view similar to FIG. 3 showing the lower portion of the sliding door security insert assembly shown in FIG. 2.

Referring additionally to FIGS. 3 and 4, the assembly 10 is first inserted upwardly between spaced parallel downwardly extending upper track portions J and K of a conventional sliding upper track A. Top panel 30 is rigidly attached atop the upper transverse member 18 by conventional threaded fasteners 34. Note that the thickness of top panel 30 is preferably equal to the thickness of the insert frame 12.

After inserting the upper portions 30*a* of top panel 30 between upper track portions J and K and against anti-friction brushes L and M which are inwardly disposed as shown thereagainst, the lower transverse member 20, having a generally wedge-shaped bottom edge cavity 38, is rested atop an elongated sliding guide H of a lower sliding door frame track B.

At this point, the assembly 10 and insert frame 12 may be lifted from engagement with the lower track B to permit unauthorized entry thereby. This is due to gap 36 being typically larger than the vertical movement necessary to disengage the wedge-shaped cavity 38 from the sliding guide H.

To compensate and to prevent unauthorized removal of the insert frame 12, an elongated compensating locking shim 32 is provided and is inserted as shown in FIGS. 1 and 3 atop the central elongated web 30*b* of the top panel 30. This will reduce the gap down to 36*a* seen in FIG. 3 which is a smaller distance than required to lift the lower transverse member H from engagement with the lower track B.

Figure 5:
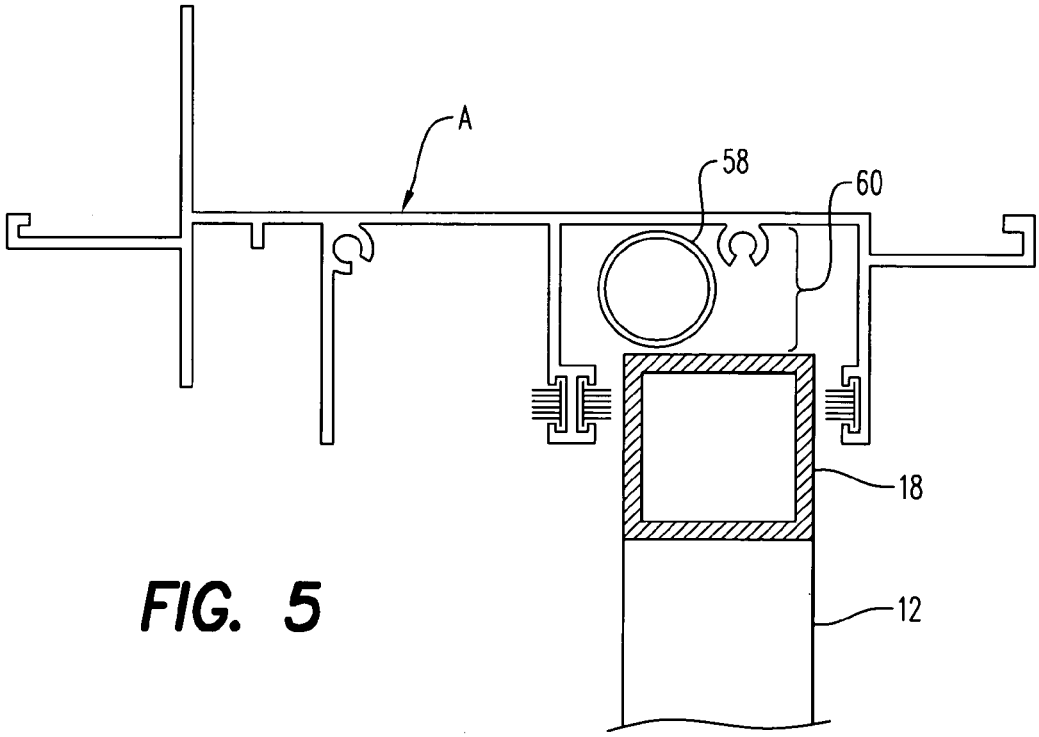
FIG. 5 is an alternate embodiment of the inventive aspect of the invention shown in FIG. 3.

Referring to FIG. 5, an alternate embodiment of the elongated locking shim 58 is provided in the form of an elongated tubular member 58. This embodiment 58 reduces the lifting gap of the insert frame 12 from that shown at 60 to substantially no lifting movement whatsoever without causing undue frictional resistance by the insertion of this locking shim 58 in a manner shown in FIG. 1 during normal sliding door D operation.

Referring again specifically to FIG. 2, the embodiment 10 includes the insert frame 12 which has a height (or length) substantially equal to that of the sliding door D which moves in the direction of the horizontal arrow between the upper and lower tracks A and B, respectively of sliding door frame F. The stile G of sliding door D positioned snugly against vertical stile 16 will hold the assembly 12 in the position shown and as previously described between the vertical stile G and door vertical jamb C. Accompanying this embodiment 10, the elongated locking shim 32 or alternately 58 in FIG. 5, secures the arrangement between the upper and lower tracks A and B as previously described.

Figure 1A:
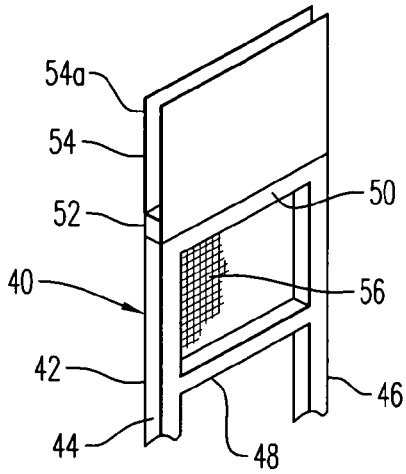
FIG. 1A is an alternate universal height embodiment of the invention shown in FIG. 1.

However, there is a broad variety of sliding door heights which may be encountered both as new product in the marketplace and in existing structures. These sliding doors may generally range in height from about 77" to 96", depending on age and type of installation. Referring additionally to FIG. 1A, a universal embodiment 40 of the invention which includes a standardized insert frame 42 having upper and intermediate transverse members 50 and 48 and insert frame stiles 44 and 46 is also provided. The overall height of this insert frame 42 is less than the minimum height of a typical sliding door to be encountered in the marketplace. To cause the assembly 40 to have a height substantially equal to the length of a particular one of a broad range of sliding doors, a height-compensating top panel 52 is provided and is attached to the upper transverse member 50 as shown and previously described in FIG. 3. However, this compensating top panel 52 has elongated rectangular side panels 52*a* which would be selected from an array commercially available top panels when the assembly 40 is purchased, to deal with the larger sliding door height.

Alternately, these top panel portions 54*a* may be provided in a universal fashion to equal, in combination with the height of the insert frame 42, the largest sliding door height, e.g. approximately 96", which may be encountered in the marketplace. Thereafter, a simple trimming operation of these panel portions 54*a* which are typically fabricated of aluminum or wood sheet material, may be effected to reduce the overall height of this embodiment to substantially equal that of the longer sliding door. In this embodiment, a screen mesh 56 is added as an insect barrier.

Referring again to FIG. 1, two additional unique aspects of the present invention are there shown. First, the mating door stile G of the sliding door D will typically have a locking latch (not shown) which is lockingly engageable with mating structure (also not shown) attached to the upright door jamb C. To insure that the facing surfaces of the upright stile member 16 and the sliding door stile G mate directly against one another, a lock cut out slot 28 formed into the insert frame stile 16 is also provided.

To insure centralized, symmetric alignment and reinforced engagement between the insert frame stile 16 and the sliding door stile G, one or more pairs of offset locking pins 24 and closely spaced corresponding locking pin receiving holes 26 are also provided. These locking pins 24 are threadably secured into the insert frame stile 16 and extend therefrom approximately 1". Matching hole (not shown) is drilled into the sliding door stile G to mateably receive each of these locking pins 24. Additionally, the same locking pin 24 is threadably engaged into and laterally extending from the sliding door stile G in spaced relation so it exactly aligns with the locking pin hole 26. It is preferred that at least two such pairs of offset locking pins and locking holes as shown in FIG. 1 be provided for maximum strength, alignment and security when the assembly 10 is in use.

Figure 6:
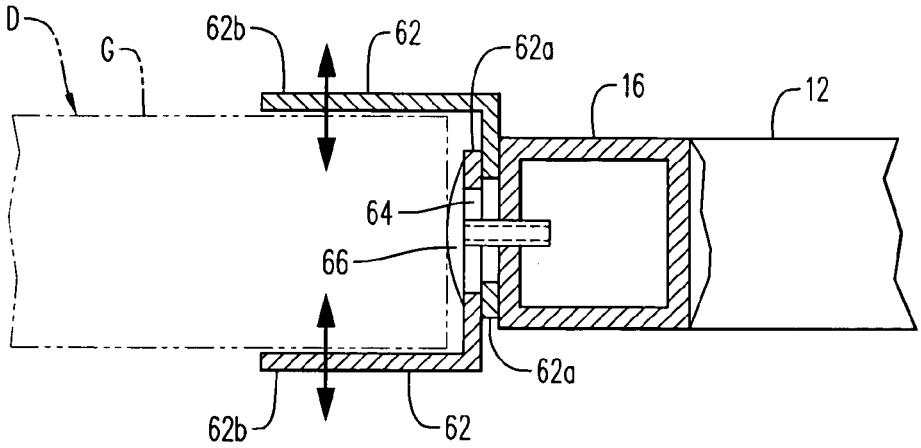
FIG. 6 is a top plan section view of another embodiment of the invention positioned for use against a sliding door stile shown in phantom.

An alternate interconnection between the respective upright stiles 16 and G of the insert frame 12 and the sliding door D is provided and is shown in FIG. 6. In this interconnection embodiment, two elongated L-section channels 62 are adjustably attachable through elongated slots 64 formed into the overlapping flanges or legs 62*a* of each of the channels 62. A large headed threaded fastener 66 is threadably engaged through both slots 64 into the upright frame insert stile 16 as shown. Prior to tightening of these fasteners 66, the channels 62 are moved in and out in the direction of the arrows to place flanges 62*b* snugly against stile G such that the thinner (or thicker) insert frame 12 may be centrally aligned with the thicker (or thinner) sliding door stile G of sliding door D. The importance of this aspect of the invention is to insure that the upper and lower engagements of the assembly 10 with respect to the upper and lower sliding door frame tracks A and B as previously described will be maintained. Any improper offset could cause binding and/or disengagement with respect to these upper and lower tracks A and B. Moreover, should an offset arrangement between stile 16 and G be desirable, there is sufficient adjustment within slots 64 to accommodate such a desirable offset from the symmetrical arrangement shown in FIG. 6. Lastly, any prying apart effort between the stiles 16 and G to force entry will be resisted, not only by conventional locks or pins (not shown) for the partially open sliding door D, but also by fasteners 66.

Referring now to FIGS. 7 to 10, a fully incrementally adjustable embodiment of the invention, now preferred, is there shown which more easily accommodates the varying heights of sliding doors and their accompanying door frame F. This adjustable-in-height embodiment, an alternate to that shown in FIG. 1A, includes a modified insert frame 72 having a lower adjusting plate 102 securely attached to the upper wall 104 of the second highest transverse member 76. The upper transverse member 74 has end apertures formed therein which slidably accommodate and support an inverted U-shaped adjusting member 78 having upright elongated hollow legs 80 and a transverse upper member 84.

Figure 7:
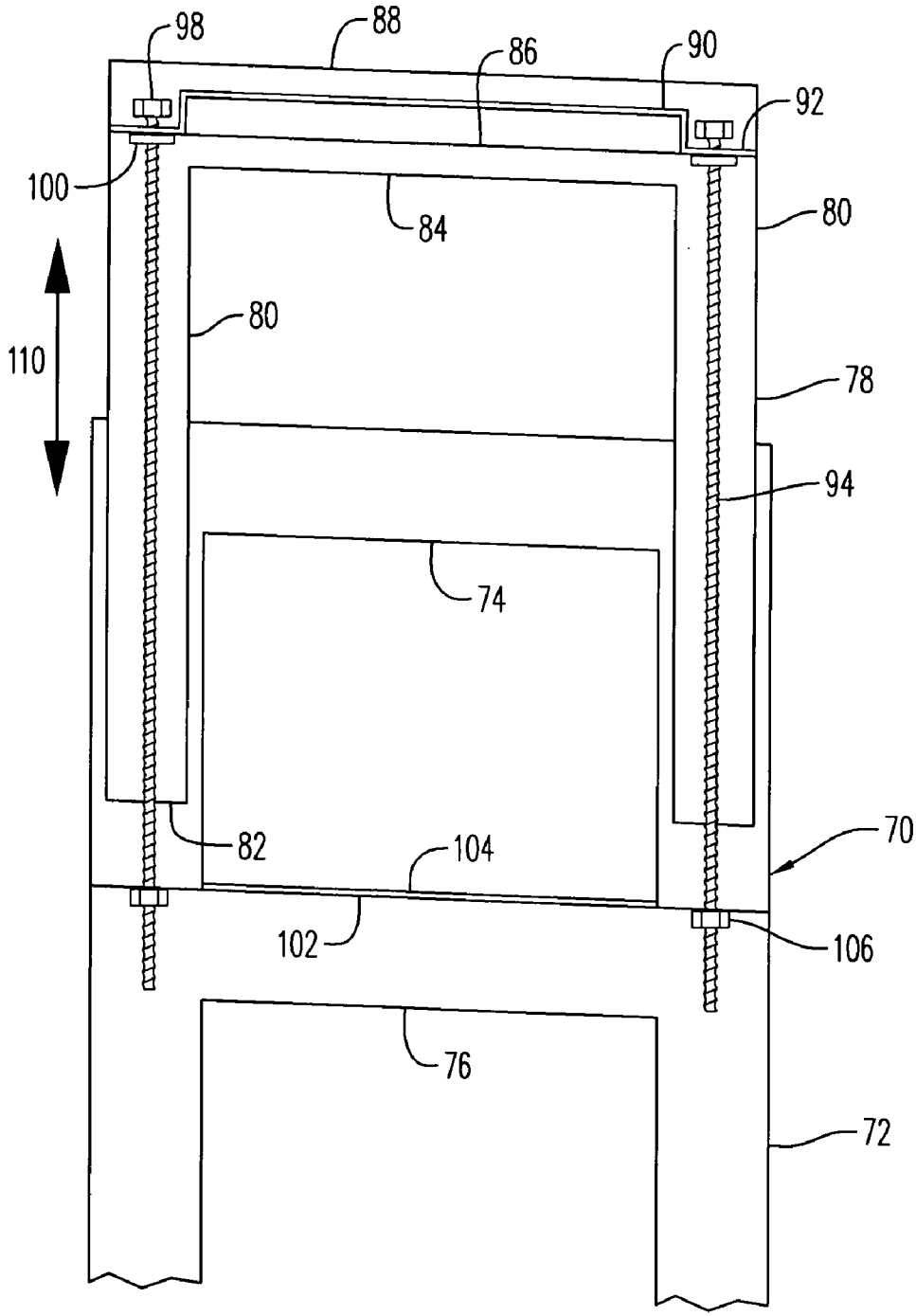
FIG. 7 is front elevation view of an upper portion of a fully adjustable embodiment of the invention.

The upright legs 80 slidably engage for movement in the direction of arrow 110 in FIG. 7 so as to vary the height of top flanges 88 to insure proper engagement into the upper track portions J and K of the upper track A.

Figure 9:
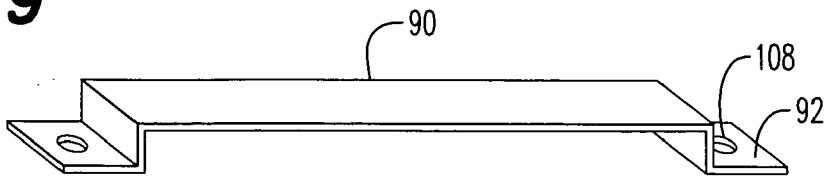
FIG. 9 is a perspective view of the top plate of FIG. 8.
Figure 8:
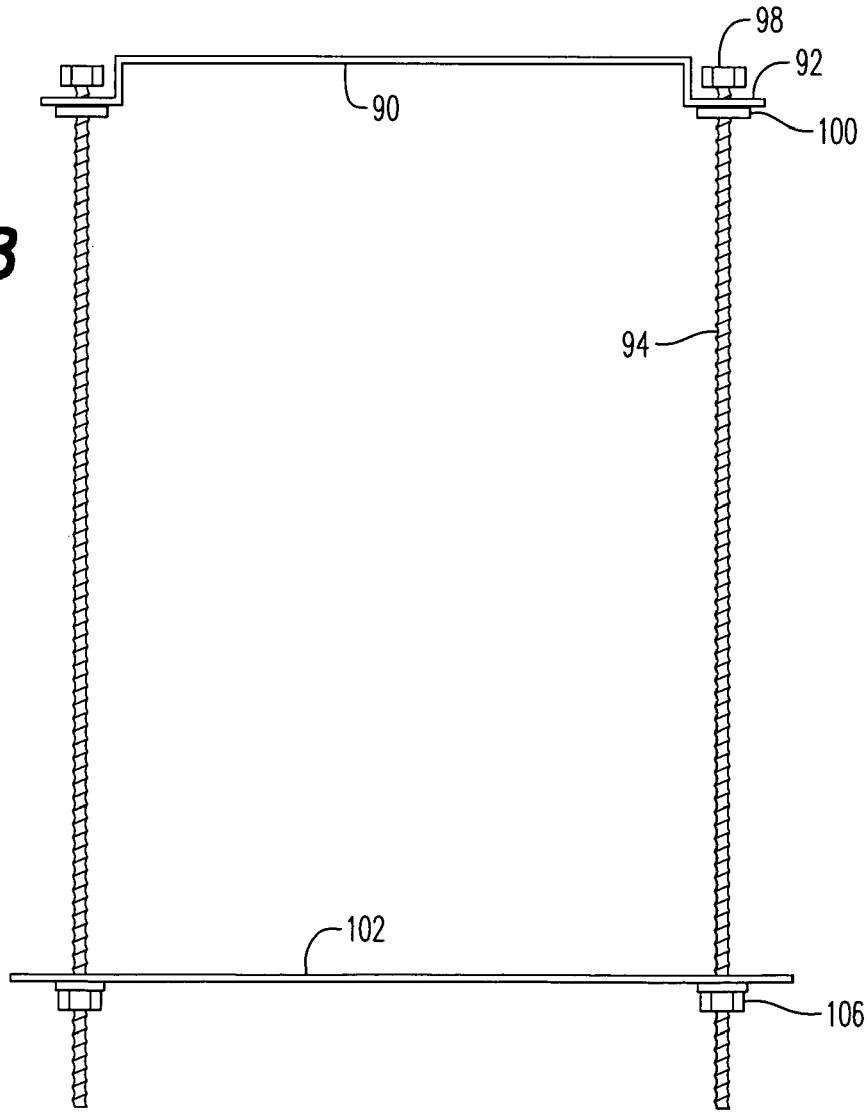
FIG. 8 is a front elevation view of the adjusting mechanism of FIG. 7.
Figure 10:
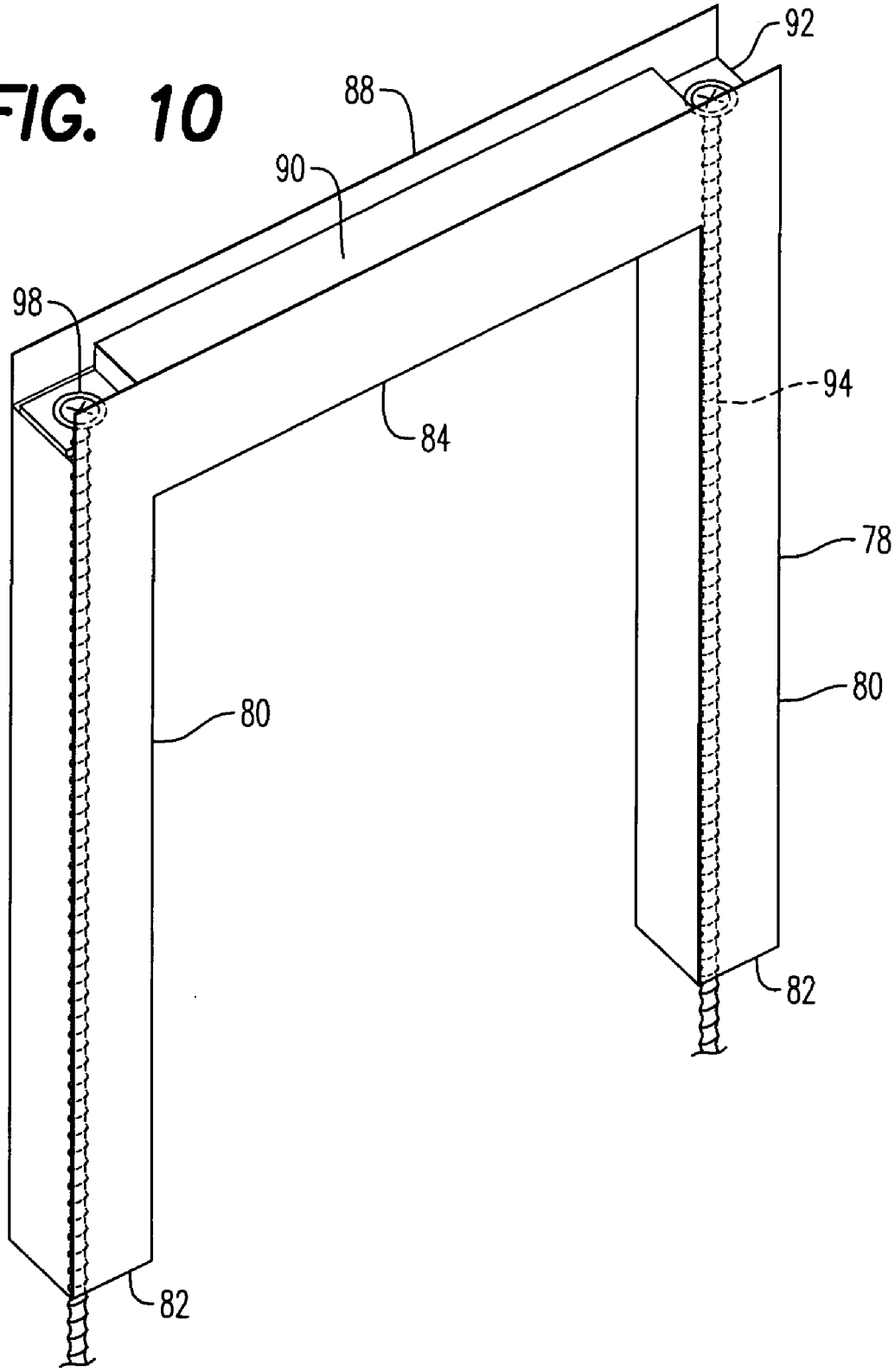
FIG. 10 is a perspective view of the upper adjustable portion of the embodiment shown in FIG. 7.

Two elongated threaded shafts 94 are held for rotation only within mating apertures 108 in the end portions 92 of a top plate 90 as best seen in FIG. 9. A bolt nut or head 98 is lockably engaged or made a part thereof of the elongated threaded shafts 94 while a non-slidable washer 100 is attached in spaced relationship on the lower side of flanges 92 as shown. The lower end portions of the threaded shafts 94 are engaged through mating apertures in the bottom plate 102 and held in threaded engagement therewith by a threaded nut 106 which is affixed to the bottom surface of the bottom plate 102 in alignment with the holes formed through end portions thereof.

The top plate 88 bears against bearing plate 86 of the transverse upper member 84 whereby, rotation of the hex drive members 98 causes threaded movement of each of the corresponding threaded shafts 94 within threaded nuts 106 to effect height adjustment in the direction of arrow 110 of the telescoping adjusting member 80.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A sliding door security insert assembly installable into an opening made when one sliding door mounted for lateral movement in a door frame including aligned parallel upper and lower tracks and vertical door jambs defining spaced edges of the door frame, the sliding door including spaced upright door stiles, is partially opened to define the opening between one door jamb and a facing one of the door stiles, said assembly comprising:

a substantially rectangular insert frame having two spaced upright insert frame stiles and spaced upper, lower and intermediate transverse members connected to and extending between said insert frame stiles;

said lower transverse member adapted to be supported on the lower track while said upper transverse member is adapted to be positioned into the upper track for lateral sliding movement only of said assembly;

an elongated locking shim positionable between said upper transverse member and the upper track preventing said insert frame from being lifted a distance sufficient to disengage said lower transverse member from the lower track;

a pair of offset locking pins, one pin of which is attached to and laterally extends from one said insert frame stile and adapted to be inserted into a mating first hole formed into the facing sliding door stile while another pin of said pair of locking pins is attached to and laterally extends from the facing sliding door stile adjacent to the first hole and in alignment with a second hole formed into said insert frame stile whereby said insert frame and the sliding door are connected together by said locking pins when said insert frame is positioned in the opening and against the sliding door.

2. A sliding door security insert assembly installable into an opening made when one sliding door mounted for lateral movement in a door frame including aligned parallel upper and lower tracks and vertical door jambs defining spaced edges of the door frame, the sliding door including spaced upright door stiles, is partially opened to define the opening between one door jamb and a facing one of the door stiles, said assembly comprising:

a substantially rectangular insert frame having two spaced upright insert frame stiles and spaced upper, lower and intermediate transverse members connected to and extending between said insert frame stiles;

said insert frame having a height substantially less than that of the sliding door;

said lower transverse member adapted to be supported on the lower track;

a height compensating top member coupled to and upwardly extending from, said top member adjustable to vary an overall height of said insert assembly to be substantially equal to that of the sliding door, an upper margin of said top member being adapted to be positioned into the upper track for lateral sliding movement only of said assembly; and a pair of offset locking pins, one pin of which is threadably attached to and laterally extends from one said insert frame stile and adapted to be inserted into a mating first hole formed into the facing sliding door stile while another pin of said pair of locking pins is threadably attached to and laterally extends from the facing sliding door stile adjacent to the first hole and in alignment with a second hole formed into said insert frame stile, whereby said insert frame and the sliding door are connected together by said locking pins when said insert frame is positioned in the opening and against the sliding door.

3. A sliding door securing insert assembly as set forth in claim 2, wherein said top member includes:

a height compensating top panel attachable to and upwardly extending from, said upper transverse member, said top panel, in combination with said insert frame having an overall height substantially equal to that of the sliding door, said top panel being adapted to be positioned into the upper track for lateral sliding movement only of said assembly.

4. A sliding door securing insert assembly as set forth in claim 2, wherein said top member includes:

a U-shaped height compensating member having spaced parallel downwardly extending legs and a horizontal transverse member which defines said upper margin;

said spaced legs being slidably engageable for substantially only longitudinal movement with respect to an upper end of said insert frame;

elongated threaded height adjusting members coupled between the upper end of said insert frame and said height compensating member to effect vertical height adjusting movement and securement of said height compensating member and the upper end of said insert frame whereby the overall height of said insert assembly is variable.

* * * * *